US011352907B2

(12) United States Patent
Müller et al.

(10) Patent No.: US 11,352,907 B2
(45) Date of Patent: Jun. 7, 2022

(54) DEVICE FOR ASSEMBLING AND DISASSEMBLING A COMPONENT OF A GAS TURBINE

(71) Applicant: Siemens Energy Global GmbH & Co. KG, Munich (DE)

(72) Inventors: Dirk Müller, Mulheim a.d.Ruhr (DE); Christian Kowalzik, Berlin (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 599 days.

(21) Appl. No.: 16/325,829

(22) PCT Filed: Sep. 7, 2017

(86) PCT No.: PCT/EP2017/072434
§ 371 (c)(1),
(2) Date: Feb. 15, 2019

(87) PCT Pub. No.: WO2018/054690
PCT Pub. Date: Mar. 29, 2018

(65) Prior Publication Data

US 2019/0211712 A1 Jul. 11, 2019

(30) Foreign Application Priority Data

Sep. 20, 2016 (DE) ..... 10 2016 217 980.2

(51) Int. Cl.
*F01D 25/28* (2006.01)

(52) U.S. Cl.
CPC ..... *F01D 25/285* (2013.01); *F05D 2230/72* (2013.01); *F05D 2260/02* (2013.01)

(58) Field of Classification Search
CPC ..... F01D 25/285; F05D 2230/72; F05D 2230/80; F05D 2260/02
See application file for complete search history.

(56) References Cited

U.S. PATENT DOCUMENTS

| | | | | |
|---|---|---|---|---|
| 5,971,702 | A | 10/1999 | Afton et al. | |
| 2008/0011932 | A1* | 1/2008 | Stretton | B64F 5/50 248/544 |
| 2010/0163705 | A1* | 7/2010 | Sassatelli | F16C 32/0666 248/676 |

(Continued)

FOREIGN PATENT DOCUMENTS

| | | |
|---|---|---|
| DE | 19919650 A1 | 12/1999 |
| EP | 2045472 A1 | 4/2009 |

(Continued)

OTHER PUBLICATIONS

Machine Translation of EP 2045472 (Year: 2009).*

(Continued)

*Primary Examiner* — Christopher M Koehler

(57) ABSTRACT

A device for assembling and disassembling a component of a gas turbine, having a rail system with at least two running rails. A carriage which can be pushed on the running rails along a specified movement axis is provided on the running rails, and the carriage has a securing device which is designed to secure a fitting section of a first carriage insert in a force-fitting manner such that the first carriage insert is moved together with the carriage when the carriage is moved on the running rails.

15 Claims, 4 Drawing Sheets

(56) References Cited

U.S. PATENT DOCUMENTS

| | | | | |
|---|---|---|---|---|
| 2014/0123680 | A1 | 5/2014 | Sancewich | |
| 2015/0026979 | A1* | 1/2015 | Muller | B23P 19/04 29/889.1 |
| 2015/0337685 | A1* | 11/2015 | Golubic | F01D 25/24 415/214.1 |
| 2016/0010504 | A1* | 1/2016 | Lanni | F04D 17/10 29/889.1 |

FOREIGN PATENT DOCUMENTS

| | | | |
|---|---|---|---|
| EP | 2949886 | A1 | 12/2015 |
| JP | 2010156333 | A | 7/2010 |
| KR | 20150063538 | A | 6/2015 |
| WO | 2013098028 | A1 | 7/2013 |
| WO | 2014154663 | A1 | 10/2014 |

OTHER PUBLICATIONS

PCT International Search Report and Written Opinion of International Searching Authority dated Dec. 14, 2017 corresponding to PCT International Application No. PCT/EP2017/072434 filed Jul. 9, 2017.

* cited by examiner

DEVICE FOR ASSEMBLING AND DISASSEMBLING A COMPONENT OF A GAS TURBINE

CROSS REFERENCE TO RELATED APPLICATIONS

This application is the US National Stage of International Application No. PCT/EP2017/072434 filed Sep. 7, 2017, and claims the benefit thereof. The International Application claims the benefit of German Application No. DE 10 2016 217 980.2 filed Sep. 20, 2016. All of the applications are incorporated by reference herein in their entirety.

FIELD OF INVENTION

The present invention relates to a device for installing and removing a component of a gas turbine, and to a method for using such a device, and also to a rail system such as is known from such a device.

BACKGROUND OF INVENTION

Devices of said type are typically required during maintenance work at a gas turbine, in order, for example, to be able to replace machine or bearing components of the gas turbine. It is necessary in particular during maintenance measures at the bearing components of a gas turbine for bearing components or components operatively connected thereto to be able to be removed from the gas turbine without the gas turbine having to be completely disassembled.

For example, in this regard, WO 2013/098028 A1 discloses a device for installing or removing bearing components at the gas turbine, which device is designed in the form of a rail system for fastening to the gas turbine end, wherein a fastening plate is attached to the housing of the gas turbine. In this case, the rail system comprises two running rails on which the bearing or other components can be directly supported. In order, for example, to remove the bearing from the gas turbine, the supporting force of the rotor of the gas turbine on the bearing is reduced by suitable measures, as a result of which the loading of the bearing is reduced to such an extent that the latter can be removed by stripping it off over the end of the rotor. During the removal process, the bearing is supported with the aid of the two running rails such that the weight force of the bearing does not have to be supported by the maintenance personnel or other devices. In addition to controlled removal of the bearing, this also allows the subsequent handling to be performed in a controlled and safe manner.

However, a problem with the device known from the prior art is that, in some cases, the maintenance measures in the region of the bearing of a gas turbine require the removal of multiple components from the gas turbine. However, the rigid fastening of the running rails to the housing of the gas turbine allows only the controlled and safe removal of those components which have a suitable orientation in relation to the running rails. Thus, the running rails are aligned for example such that, when the bearing is pulled off over the end of the rotor, the outer wall of the main bearing body can be supported without further height adaptation by the running rails. Consequently, further components, which are attached for example to the rotor or else in the bearing region but which do not have a suitable alignment in relation to the running rails, would, for the support by the two running rails, firstly have to be raised or lowered in order to subsequently be able to be supported on the running rails.

For relatively heavy components which, in the event of improper handling, can undergo mechanical impacts and actions of force and in this way be damaged, this type of handling presents a maintenance risk which should be avoided.

SUMMARY OF INVENTION

In this respect, an object is to propose a device for installing and removing a component of a gas turbine, which is provided in particular for maintenance work in the bearing region of the gas turbine, wherein the device can be safely used in a flexible manner for the installation and removal of different components whose arrangement in the gas turbine in particular has different height levels. At the same time, it is intended for safe and controlled working at the gas turbine to be made possible. This object, on which the invention is based, is achieved by a device and by a method and also by a rail system according to the claims.

In particular, the object on which the invention is based is achieved by a device for installing and removing a component of a gas turbine, comprising a rail system having at least two running rails, wherein there is provided on the running rails a carriage which is able to be displaced on the running rails along a predetermined displacement axis, wherein the carriage has a fixing device which is formed to fix a fitting section of a first carriage insert in a force-fitting manner such that, when the carriage is displaced on the running rails, the first carriage insert is displaced along therewith, wherein the carriage has a height-adjustment means which is designed to adjust the fixing device in height when the device is used as intended. In the present case, the height relates to a direction which is typically oriented parallel to the direction of the earth's gravitational field. The carriage thus allows, even without for example having to exchange the respective carriage insert, flexible adaptation to different components, which for example are removed from the gas turbine, or installed into the gas turbine, at different height levels.

Furthermore, the object on which the invention is based is achieved by a method for using a device described above and below, which method comprises the following steps:—providing a rail system having at least two running rails, wherein there is provided on the running rails a carriage which is able to be displaced on the running rails along a predetermined displacement axis;—fastening the rail system to a gas turbine;—placing a first carriage insert on the carriage and fixing said insert in a force-fitting manner with the aid of a fixing device of the carriage;—displacing the carriage on the running rails, wherein the first carriage insert is displaced along therewith too.

At this juncture, it should be pointed out that the present invention comprises at least two running rails, in particular precisely two running rails.

It should likewise be pointed out that the component to be installed or removed of the gas turbine is in particular a part of the rotor or of the housing or of the bearing of the gas turbine and is advantageously provided in the region of the ends of the gas turbine at the bearing sections. However, other parts may be involved for the installation and removal, wherein said parts are typically operatively connected to the other components mentioned above. The device itself is in this respect provided in particular for fastening in the region of the rotor end of the gas turbine, wherein suitable fastening devices for attachment to the gas turbine are already known from the prior art.

The rail system is attached to the gas turbine such that the carriage is able to be displaced relative to the rail system and relative to the gas turbine along a displacement axis. If the rail system is provided for installing and removing bearing components at the gas turbine, said system is typically attached at an end to the gas turbine in the region of the housing such that the displacement axis extends parallel to the axis of longitudinal extent of the rotor of the gas turbine.

The carriage serves for the support of the weight of the component and introduction thereof into the rail system with respect to the rail system. In other words, the carriage allows a suitable distribution of the weight force of the respective component over the at least two running rails. The component involved is itself in each case supported on the first carriage insert, or, as will be explained further below, on a second carriage insert, such that the weight force of the respective component can be dissipated via the carriage insert onto the carriage and into the running rails. In this case, the carriage insert itself is advantageously adapted to the geometry of the component which is to be installed or removed. In particular, the carriage insert has a suitable geometry such that, when the carriage insert is arranged on the carriage as intended and the carriage is arranged on the running rails as intended, the respective component can be directly laid on the carriage insert from the gas turbine without a further device for raising or for lowering the component. In other words, the carriage insert serves for the geometrical and level-related technical adaptation of the device to the component which is in each case to be installed or removed. According to the embodiment, it is then possible for example for each component to be assigned a separate carriage insert, with the result that the problem-free removal of all the components from the gas turbine can be promoted through selection of the respective carriage inserts in succession in a corresponding sequence.

At this juncture, it should also be pointed out for the sake of emphasis that, in addition to the running rails and the carriage, the device according to the invention also has a first carriage insert, or alternatively also has a second carriage insert, wherein the entirety of all the components should be understood as being a system. In other words, the specified components are comprised by the respective device.

The present invention furthermore provides that the carriage has a suitable fixing device, which is formed such that a fitting section of the first carriage insert can be connected in a force-fitting manner to the carriage, and that, when the carriage is displaced on the running rails, it is also the case that the first carriage insert is, together with the component situated on the latter in each case, displaced along with said carriage too. Owing to the provision of a fitting section, which brings about a form fit and by way of which the force-fitting connection of carriage and carriage insert is made possible, the respective carriage insert can be advantageously connected to the carriage. The quick insertion or removal of the first carriage insert into/from the carriage is important since, in this way, it is possible for different carriage inserts for different components to be exchanged on the carriage in a quick and uncomplicated manner. Therefore, if, for example, various components are removed in sequence from the gas turbine, it is possible for individual carriage inserts to be provided for the individual components, which carriage inserts can be inserted into the carriage quickly and without a great loss of time. After work has been carried out or after the installation and removal of a component has been carried out, the in each case next carriage insert can consequently be inserted into the carriage and the sequence of individual work steps can be assisted in a geometrically adapted manner.

According to a first embodiment of the device, it is provided that the first carriage insert is connected exclusively via surface contact of its fitting section to the carriage and, in particular, a more extensive connection of the two is not provided. Such a more extensive connection could be for example a screw connection, which is not provided according to the embodiment. According to the embodiment, exclusively the surface contact is sufficient for bringing about a force fit between carriage and first carriage insert, wherein both can be connected to one another as intended, and separated again, in a quick and uncomplicated manner.

According to a further embodiment of the device according to the invention, it is provided that the fixing device is designed in the form of one or more transverse struts between two slide sections of the carriage, wherein the transverse struts and regions of the fitting section of the first carriage insert are able to engage into one another. According to the embodiment, the slide sections are provided for being able to be displaced on in each case one running rail, and they form in this way the contact sections between the running rails and the carriage. Each running rail is typically assigned one slide section. For the low-friction displacement of the slide sections on the running rails, the latter typically have ball rollers or cylinder rollers, wherein the slide sections can be correspondingly moved on said ball rollers or cylinder rollers along the above-described displacement axis. When the carriage is displaced, the one or more transverse struts of the fixing device allow a suitable transmission of force of the first carriage insert to the carriage, or vice versa. In this case, the fitting section of the first carriage section is formed geometrically such that it achieves a suitable force fit with the transverse strut/transverse struts if the first carriage insert has been inserted into the carriage as intended. If multiple transverse struts are provided, the fitting section can engage between the individual transverse struts and, for example, completely fill the space section between the transverse struts. Accordingly, a contact is achieved, with the required force fit being ensured when corresponding displacement along the displacement axis is realized. At this juncture, it is helpful to mention that the required force fit merely has to be present for action of force in predetermined directions. In particular, said force fit has to be provided for action of force parallel to the displacement axis, in order that the first carriage insert can however be removed easily from the carriage again. Thus, furthermore, a force fit must not be present for example for a predetermined other movement direction, that is to say for example perpendicular to the direction of the displacement axis, since otherwise a quick and uncomplicated exchange of the carriage insert would not be made possible.

According to a further embodiment, it is provided that the first carriage insert has rollers on the side opposite the fitting section. In particular, these are at least two sets of rollers arranged parallel to one another. The rollers are for example ball rollers or cylinder rollers, which allow a rolling movement in a predetermined direction or even in a predetermined rolling plane. The component to be handled by way of the device according to the embodiment can thus be displaced onto the first carriage insert in a relatively simple manner via the rollers, wherein after displacement has been carried out, the system composed of first carriage insert and carriage as a unit can further be displaced on the running rails. In order, for example, to be able to lay the component onto the first carriage insert, it is possible for the carriage to be fixed on the rail system by means of a unit (not described further) such that it is only after successful displacement of the component onto the first carriage insert has been carried out that this fixing is released again and said system composed of component, carriage insert and carriage can be moved on the running rails. The rollers on the first carriage insert therefore facilitate the movement of the component to be installed or removed onto the first carriage insert.

According to a further embodiment, it is provided that the first carriage insert has, on the side opposite the fitting section, a shaped section which is designed for the insertion of a further, second carriage insert, wherein the second carriage insert has, for its part, a section which is able to be connected in a force-fitting manner to the shaped section. As already described for the set-up between the carriage and the first carriage insert, it is also possible for a force-fitting connection to be established between the first and second carriage inserts. In this case, both carriage inserts are not connected to one another more extensively, with the result that simple removal of the second carriage insert from the first one is possible. Compared with the first carriage insert, the second carriage insert typically has a different geometry, the latter allowing differently shaped components of the gas turbine to be advantageously supported with the aid of both carriage inserts. However, the second carriage insert may also serve merely for varying the height level of the first carriage insert in a suitable manner, in order for example to be able to install and remove a component which has to be supported, and displaced, at a different height level. The second carriage insert is in particular suitable for components of relatively complex shape which have to be inserted into the gas turbine or removed therefrom, wherein said components have to be supported for example not by one bearing surface but by multiple different bearing surfaces when displacement is realized. Said different bearing surfaces accordingly have different height levels, which can be described for example by concentrically arranged cylinder shells of different radii.

According to a further aspect of this embodiment, it may be provided that, when the device is used as intended, the second carriage insert has rollers on the side opposite the shaped section. It is in particular the case that there are at least two sets of rollers, arranged parallel to one another, or even single rollers. The rollers are for example ball rollers or, as mentioned above, cylinder rollers, which can allow a rolling movement in a predetermined direction or even in a rolling plane. As already explained above, it is thus possible for the component to be handled by the device to be easily laid, and displaced, on the rollers. It is possible specifically when components are being installed for quick positioning of the component with relatively low application of force to thus be achieved by the maintenance personnel.

According to an embodiment of the invention, it is provided that the first carriage insert and/or the second carriage insert are/is of mirror-symmetrical design, wherein, when intended use is realized, the plane of mirror symmetry extends parallel to the displacement axis. The plane of mirror symmetry very particularly includes the displacement axis itself. Consequently, the components which are to be removed or installed can be positioned well with respect to the displacement axis, and the operating personnel do not have to perform any cumbersome orientation of the component, which significantly facilitates the handling of the component.

According to a refinement, it is also the case that the first carriage insert and/or the second carriage insert may have at least in each case one roller on each of the mutually opposite sides, which sides are defined by the plane of mirror symmetry. It is in particular the case that there are again at least two sets of rollers arranged parallel to one another, wherein in each case one set is arranged on in each case one side of the plane of mirror symmetry. The rollers are for example ball rollers or again cylinder rollers, which allow a rolling movement in a predetermined rolling direction or in a predetermined rolling plane. In this case, the component to be handled by the device is laid on the rollers and can be positioned suitably for the installation or removal in a manner relatively without application of force.

According to a further embodiment of the invention, it is provided that, when the device is used as intended, the second carriage insert only regionally covers the first carriage insert on the side provided for the support of a component. Consequently, the component can also be supported simultaneously against surfaces of both carriage inserts. This is an advantage in particular in the case of components of complex shape, whose safe support can be realized only by multiple support surfaces. According to the design of the respective carriage insert or of the combination of different carriage inserts, it is possible in this way for the component to be positioned quickly and safely with respect to the location of the gas turbine.

The height-adjustment means is particularly provided in or on the slide sections of the carriage. Alternatively, the provision of said height-adjustment means in the region of the fixing device can also be considered, wherein however, the stability of the system, which is required for safety reasons, can then be limited in some cases since the center of gravity would be displaced further upward. It is advantageous to form the height-adjustment means in or on the slide sections by means of adjustment screws, wherein the adjustment screws allow the adjustment in height between two plate sections, which are able to be displaced relative to one another, to be performed. The height-adjustment means in or on the slide sections also allows a suitable horizontal alignment of the carriage to be realized, with the result that the leveling of the carriage can thereby be achieved.

According to a further embodiment of the invention, it is provided that the rail system is likewise adjustable in height, wherein the individual running rails are advantageously adjustable only in a stepwise manner. In the case of stepwise adjustment, the steps are already preset to the required heights of individual components, with the result that the stepwise adjustment results in a facilitated work sequence if for example different components have to be removed, or installed, in succession. Owing to the step setting, an adjustment of the respective rail height may be omitted, with the result that, during a work sequence, the newly set-up height adjustment can be realized quickly and without a significant loss of time.

According to a likewise advantageous embodiment of the invention, it is provided that the first carriage insert and/or the second carriage insert have/has at least one roller, in particular two rollers, which are/is adjustable in height. Such a height adjustment can be achieved for example in that the rollers are designed in the form of ball rollers whose cylindrical housing is fitted in an accurately fitting blind hole of the carriage insert. If spacer plates are then introduced between the housing of the rollers and the bottom of the blind hole, the housings of the rollers can partly protrude from the blind hole but still be supported against the spacer plates and thus indirectly against the bottom of the blind hole. As a result, these rollers have a different height level. The embodiment of the invention with height-adjustable rollers is advantageous in particular if the differences in height between the individual rollers or pairs of rollers is only small and thus the insertion of a second carriage insert is not an option owing to its geometric extent.

BRIEF DESCRIPTION OF THE DRAWINGS

The invention will be described more specifically in detail below on the basis of individual figures.

In the figures.

DETAILED DESCRIPTION OF INVENTION

Figure 1:
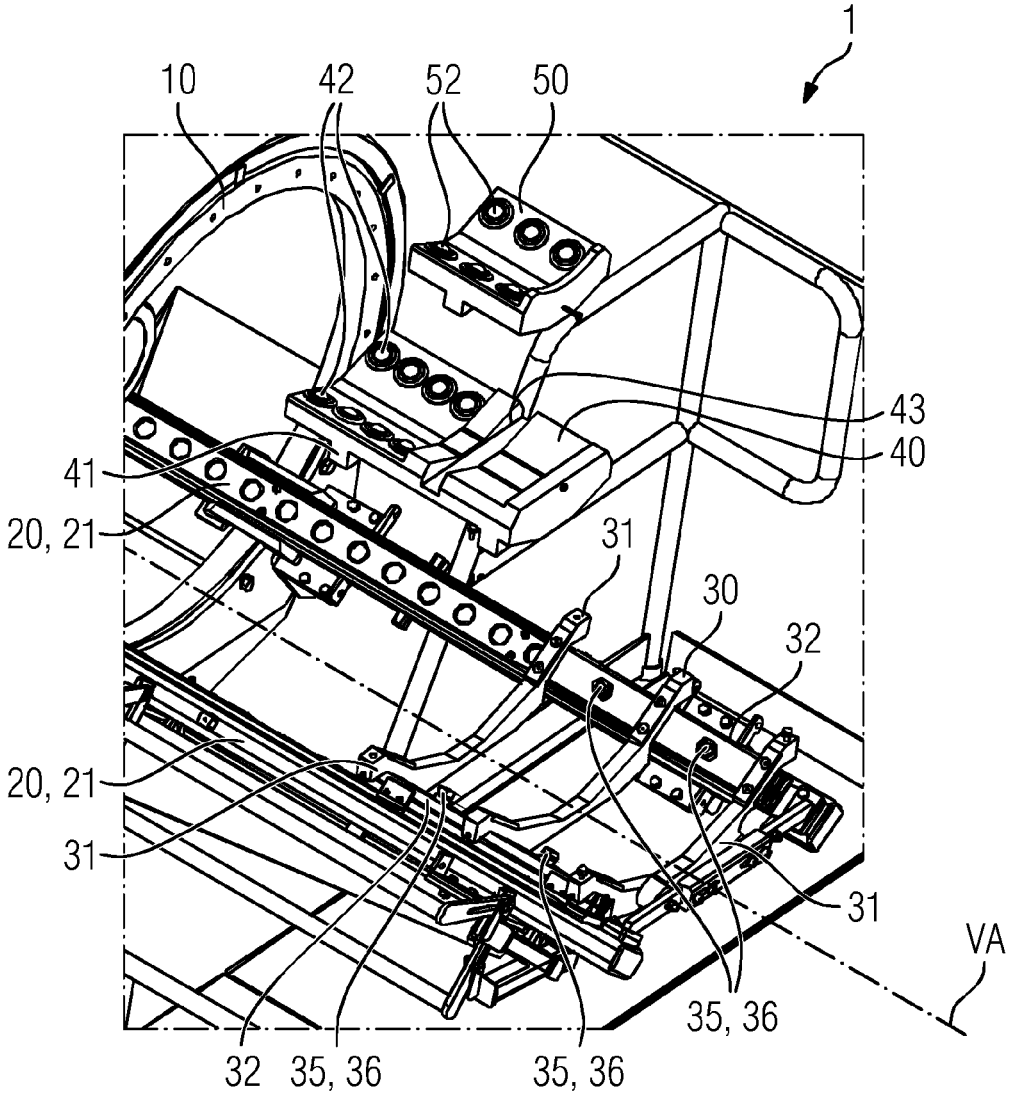
FIG. 1 shows a perspective detail view of an embodiment of the device according to the invention.

FIG. 1 shows a perspective illustration of an embodiment of a device 1 according to the invention, which is provided for installing or removing a component (not shown in the present case) of a gas turbine 10. The component involved is for example the bearing, or components operatively connected thereto, of the gas turbine 10.

The device 1 has a rail system 20 which comprises two running rails 21 in the present case. The running rails 21 themselves have, on their surface, ball rollers (not further provided with reference signs), on which a carriage 30 can be displaced along a predetermined displacement axis VA. The carriage 30 has two slide sections 32 which each bear, and have rolling contact, on the ball rollers of the individual running rails 21. Furthermore, the carriage 30 has a fixing device 31 which, in the present case, is formed by three transverse struts (not separately provided with reference signs). The transverse struts are in each case spaced apart by the same distance from the in each case adjacent transverse strut. Moreover, the transverse struts are connected to an upper plate section of the slide section 32, wherein the upper plate section has a height-adjustment means 35 which is designed in the form of an adjustment screw 36. By suitably turning the adjustment screws 36, the upper plate section is moved relative to a lower plate section of the slide section 32, with the result that the fixing device 31 is also adjusted in height. The adjustment screws 36 allow for example an adjustment of the height level of the carriage 30 with respect, for example, to a component which is to be inserted into the gas turbine or is to be removed from the latter.

The present device 1 furthermore comprises a first carriage insert 40 which, for insertion into the carriage 30, has a suitable fitting section 41 such that, for example by insertion of the first carriage insert 40 in a manner perpendicular to the displacement axis VA, both, that is to say the first carriage insert 40 and the carriage 30, are able to be connected to one another in a force-fitting manner. In this case, the force fit relates to an action of force parallel to the displacement axis VA. In comparison with differently directed directions of an action of force, a force fit does not need to be present. Specifically, the present fitting section 41 has two projections, which bear against surfaces of the transverse struts of the fixing device 31 such that, when the carriage 30 is displaced, it is also possible for example for the first carriage insert 40 to be displaced in the direction of the displacement axis. The first carriage insert 40 also has, on the side opposite the fitting section 41, two sets of rollers 42, which are advantageously designed in the form of ball rollers. In this case, the two sets of rollers 42 are in each case mutually opposite with respect to a plane of symmetry (not depicted further), which extends through the displacement axis VA. The first carriage insert 40 is also of mirror-symmetrical design, with the result that, for example, an annular or cylindrical component can then be laid on the rollers 42 of the first carriage insert 40 and orients itself on the carriage insert.

Furthermore, the first carriage insert 40 has a shaped section 43 on the side opposite the fitting section 41, which shaped section, in the present case, is designed for example merely in the form of a groove which extends perpendicular to the displacement axis VA. A suitably formed section of a second carriage insert 50 may then in turn be fitted into said groove, with the result that the second carriage insert 50 cannot be displaced relative to the first carriage insert 40 under an action of force in the direction of the displacement axis VA. The second carriage insert 50, after being correspondingly attached to the first carriage insert 40, partially covers the surface of the latter, said surface being provided for the support of a component to be installed or removed. In a manner comparable to the first carriage insert 40, the second carriage insert 50 in turn has two rollers 52, which are likewise in turn arranged on different sides of the plane of mirror symmetry mentioned above. If then a component is not formed such that it can be laid on merely one support surface, but requires the support via multiple surfaces attached at different height levels, then it is possible for one part of the component to be supported for example on the first carriage insert 40 and a further part to be supported on the second carriage insert 50. The combination of both carriage inserts 40 and 50 thus also allows components of more complex shape to be supported safely.

Figure 2:
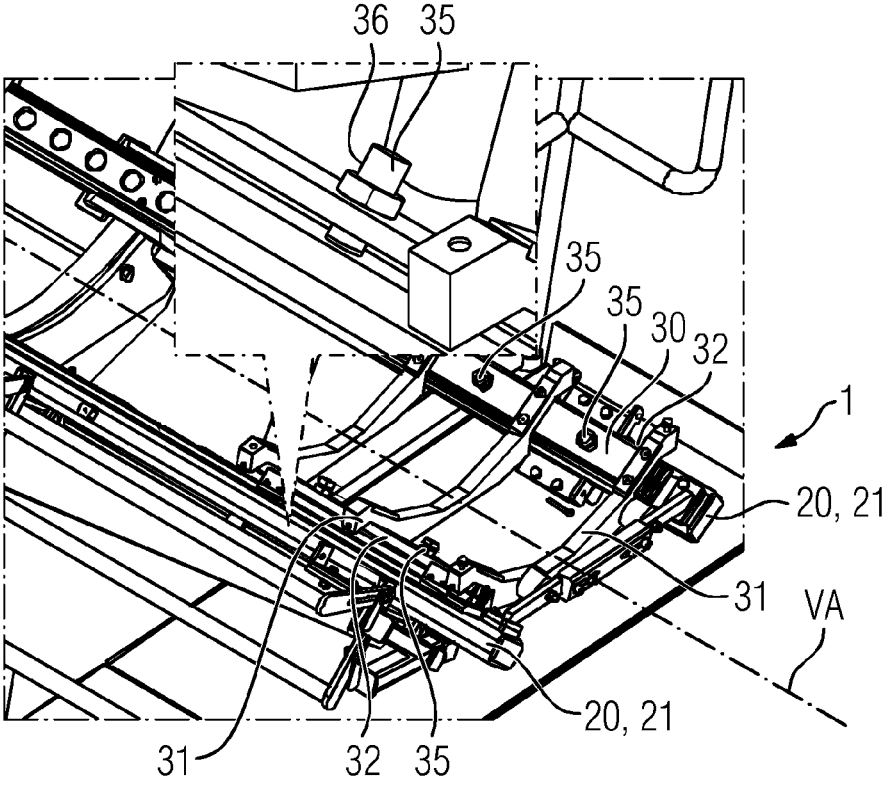
FIG. 2 shows a detail feature of the carriage, which may be provided as part of an embodiment of the device according to the invention, such as is known for example from FIG. 1.

FIG. 2 shows a partial aspect of an embodiment of the carriage 30, such as may be provided for example in the embodiment as per FIG. 1 shown above. In this case, in particular the enlarged image section of the figure illustrates the principle of the height adjustment means 35 with the aid of the adjustment screws 36 which have already been described above. The adjustment screws 36 move for example an upper plate section (not provided with a reference sign) relative to a plate section situated further below (likewise not provided with a reference sign), with the result that, when the respective adjustment screws are turned, both plate sections are able to be moved relative to one another. The movement of the different plate sections achieves a height adjustment of the fixing device 31 of the carriage 30 and thus allows for example an adjustment of the height setting of the carriage 30.

Figure 3:
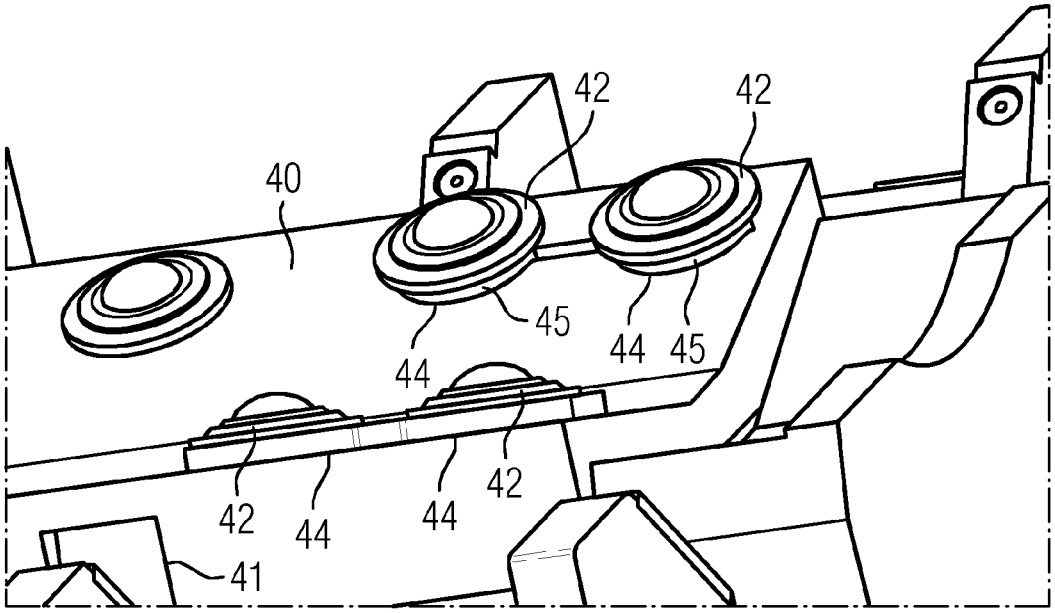
FIG. 3 shows a detail feature of a first carriage insert with height-adjustable rollers, such as may be provided for example in an embodiment of the device according to the invention according to FIG. 1.

FIG. 3 shows a detail feature of a first carriage insert 40 having height-adjustable rollers 42. In particular, the first carriage insert 40 has two pairs of height-adjustable rollers 42, which are arranged on side opposite the fitting section 41. The rollers 42 are designed in the form of ball rollers which have a cylindrical housing 45 which is in each case recessed in the carriage insert 40 in a blind hole 44.

A height adjustment of the rollers 42 can then be achieved in that the rollers 42 are temporarily removed from the blind hole 44 in order to introduce spacer plates (not shown in the present case) between the housing 45 of the rollers 42 and the bottom of the blind hole 44. Subsequently, the rollers 42 are inserted as intended again, with the result that the housings 45 of the rollers 42 partly protrude from the blind hole 44 but are still supported against the spacer plates and thus indirectly against the bottom of the blind hole 44. According to the thickness of the spacer plates, it is also thus possible to compensate for only small differences in height between the individual rollers 42, or it is also possible to realize desired, small differences in height even if the insertion of a second carriage insert 50 (not shown in the present case) is not an option owing to its extent.

Figure 4:
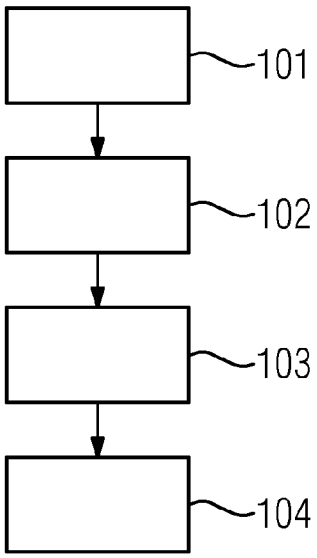
FIG. 4 shows an illustration, in the form of a flow diagram, of an embodiment of the method according to the invention for using the device described above and below.

FIG. 4 shows an illustration, in the form of a flow diagram, of an embodiment of the method according to the invention for using a device described above, which method comprises the following steps:—providing a rail system 20 having at least two running rails 21, wherein there is provided on the running rails 21 a carriage 30 which is able to be displaced on the running rails 21 along a predetermined displacement axis VA (first method step 101);—fastening the rail system to a gas turbine 10 (second method step 102);—placing a first carriage insert 40 on the carriage 30 and fixing said insert in a force-fitting manner with the aid of a fixing device 31 of the carriage 30 (third method step 103);13 displacing the carriage 30 on the running rails 21, wherein the first carriage insert 40 is displaced along therewith too (fourth method step 104).

Further embodiments will emerge from the dependent claims.

The invention claimed is:

1. A device for installing and removing a component of a gas turbine, comprising:

a rail system having at least two running rails, a carriage on the running rails which is displaceable on the running rails along a redetermined displacement axis, wherein the carriage has a fixing device which is formed to fix a fitting section of a first carriage insert in a force-fitting manner such that, when the carriage is displaced on the running rails, the first carriage insert is also displaced along therewith, wherein the carriage has a height-adjustment device which is designed to adjust the fixing device in height when installing or removing the component, wherein the first carriage insert has rollers on a side opposite the fitting section.

2. The device as claimed in claim 1, wherein the first carriage insert is connected exclusively via surface contact of the fitting section to the carriage.

3. The device as claimed in claim 2, wherein the first carriage insert is connected exclusively via surface contact of the fitting section to the carriage and a more extensive connection of the two is not provided.

4. The device as claimed in claim 1, wherein the fixing device is designed as one or more transverse struts between two slide sections of the carriage, wherein the one or more transverse struts and regions of the fitting section of the first carriage insert are able to engage into one another.

5. The device as claimed in claim 4, wherein the height-adjustment device is provided in or on the two slide sections.

6. The device as claimed in claim 1, wherein the first carriage insert has, on a side opposite the fitting section, a shaped section which is designed for the insertion of a further, second carriage insert, wherein the second carriage insert has, for its part, a section which is able to be connected in a force-fitting manner to the shaped section.

7. The device as claimed in claim 6, wherein when installing or removing the component, the second carriage insert has rollers on a side opposite the shaped section.

8. The device as claimed in claim 6, wherein the first carriage insert and/or the second carriage insert are/is of mirror-symmetrical design, wherein, when installing or removing the component, a plane of mirror symmetry extends parallel to the displacement axis.

9. The device as claimed in claim 8, wherein the first carriage insert and/or the second carriage insert have/has at least in each case one roller on each of the mutually opposite sides, which sides are defined by the plane of mirror symmetry.

10. The device as claimed in claim 6, when installing or removing the component, the second carriage insert only regionally covers the first carriage insert on a side provided for the support of a component.

11. The device as claimed in claim 6, wherein the first carriage insert and/or the second carriage insert has at least one roller which is adjustable in height.

12. The device as claimed in claim 11, wherein the first carriage insert and/or the second carriage insert have two rollers which are adjustable in height.

13. The device as claimed in claim 1, wherein the rail system is adjustable in height.

14. The device as claimed in claim 13, wherein individual running rails are adjustable only in a stepwise manner.

15. A method for installing and removing a component of a gas turbine with the device as claimed in claim 1, the method comprising:

providing thea rail system having at least two running rails, wherein there is provided on the running rails thea carriage which is displaceable on the running rails along thea predetermined displacement axis;

fastening the rail system to the gas turbine;

placing the first carriage insert on the carriage and fixing said insert in a force-fitting manner with the aid of the fixing device of the carriage; and displacing the carriage on the running rails, wherein the first carriage insert is also displaced along therewith.

* * * * *